US008343418B2

(12) United States Patent
Vincent et al.

(10) Patent No.: US 8,343,418 B2
(45) Date of Patent: Jan. 1, 2013

(54) TAP HOLE PLUG GUN

(75) Inventors: John Paul Vincent, Boksburg (ZA); Johannes Jacobus Goosen, Glen Erasmia (ZA)

(73) Assignee: TMT Tapping-Measuring- Technology GmbH, Siegen (DE)

( * ) Notice: Subject to any disclaimer, the term of this patent is extended or adjusted under 35 U.S.C. 154(b) by 241 days.

(21) Appl. No.: 12/780,239

(22) Filed: May 14, 2010

(65) Prior Publication Data

US 2010/0320654 A1 Dec. 23, 2010

(30) Foreign Application Priority Data

Jun. 20, 2009 (EP) ..... 09008106

(51) Int. Cl.
*C21B 7/12* (2006.01)

(52) U.S. Cl. ..... 266/273; 266/45; 266/272

(58) Field of Classification Search ..... 266/45, 266/272, 273, 195, 236
See application file for complete search history.

(56) References Cited

U.S. PATENT DOCUMENTS

| | | | | |
|---|---|---|---|---|
| 2,248,434 | A * | 7/1941 | Osolin et al. | 266/135 |
| 3,682,456 | A * | 8/1972 | Berczynski | 266/195 |
| 4,058,300 | A * | 11/1977 | Mailliet et al. | 266/273 |

FOREIGN PATENT DOCUMENTS

| | | | |
|---|---|---|---|
| DE | 3007072 | C2 | 9/1987 |
| JP | 2004263261 | A | 9/2004 |
| KR | 20040001760 | A | 1/2004 |

OTHER PUBLICATIONS

"European Search Report dated Nov. 18, 2009 for EP Application No. 09008106, from which the instant application is based," 2 pgs.

* cited by examiner

*Primary Examiner* — Scott Kastler
*Assistant Examiner* — Michael Aboagye
(74) *Attorney, Agent, or Firm* — Fredrikson & Byron, P.A.

(57) ABSTRACT

The embodiments of the invention relate to a tap hole plug gun for metallurgical furnaces, having a pressure cylinder for receiving the plugging compound, which has a closable filling opening for the plugging compound, and having a plugging piston for pressing the plugging compound out from a mouthpiece of the pressure cylinder pressed against the tap hole of a furnace. The pivotable safety flap for closing the filling opening of the pressure cylinder for the plugging compound is equipped with a stop, which is pivoted into the cylinder chamber of the pressure cylinder upon opening of the flap to decelerate an unintentional forward stroke of the plugging piston for pre-compression and expulsion of the plugging compound, and is pivoted out of the cylinder chamber upon closing of the safety flap.

4 Claims, 3 Drawing Sheets

Fig. 3
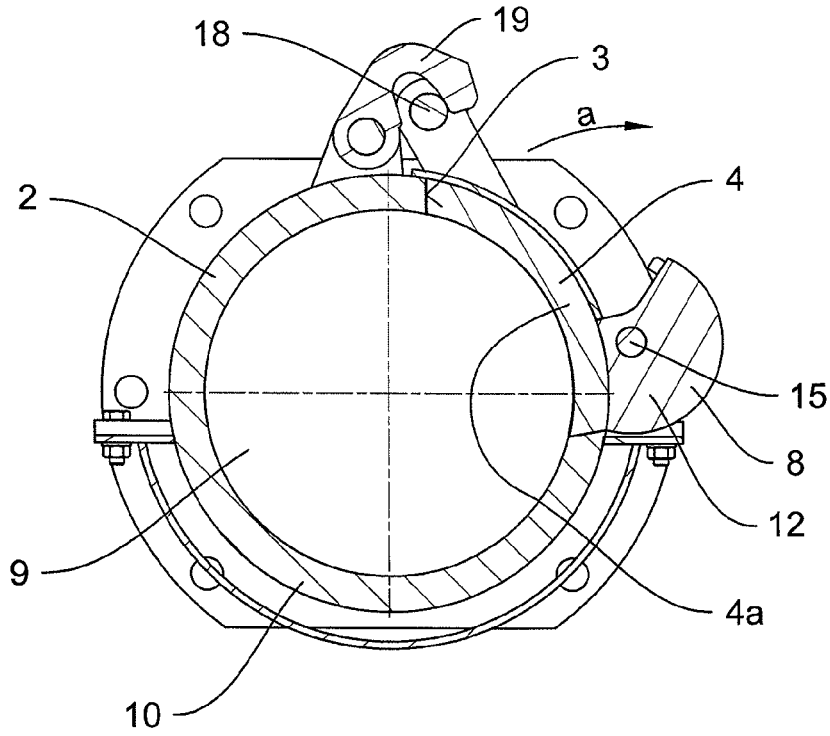
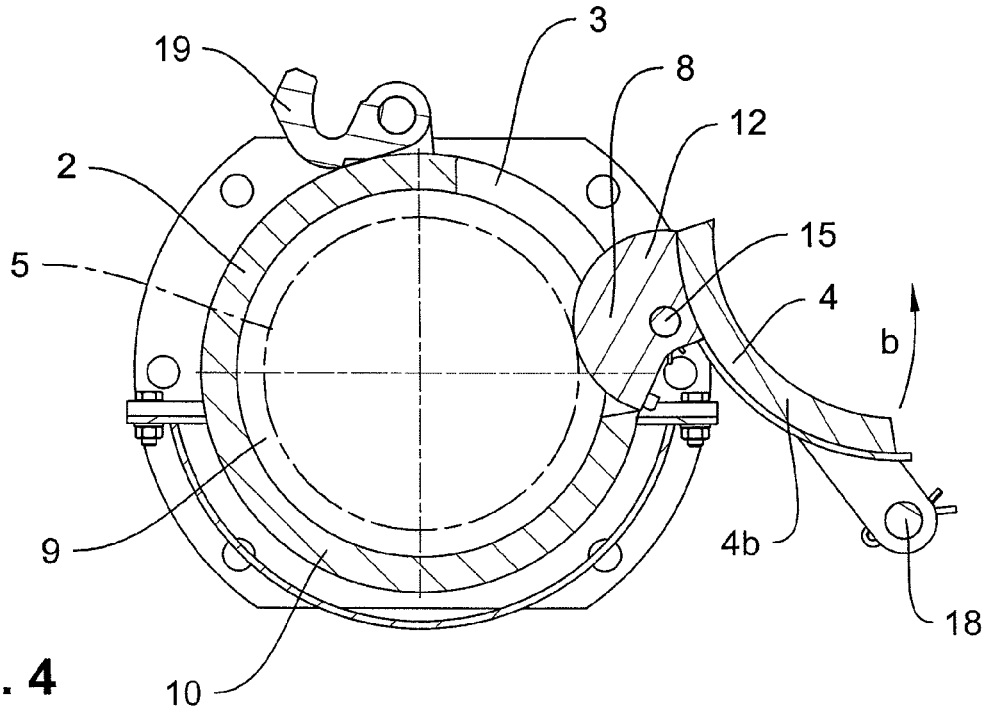
Fig. 4

TAP HOLE PLUG GUN

RELATED APPLICATIONS

This application claims priority to European Patent Application No. 09008106.8, filed Jun. 20, 2009, the teachings of which are incorporated herein by reference.

The embodiments of the invention relate to a tap hole plug gun for metallurgical furnaces, having a pressure cylinder for receiving the plugging compound, which has a closable filling opening for the plugging compound, and having a plugging piston for pressing out the plugging compound from a mouthpiece of the pressure cylinder which is pressed against the tap hole of a furnace.

The tap hole plug guns of this type described in DE 30 07 072 C2 are used for closing the tap openings of reducing or melting furnaces, e.g., blast furnaces for obtaining crude iron and low shaft furnaces for melting nonferrous metals, ferrous alloys, etc. In the plugging work step, the plug gun is pressed against the furnace facing with a great force using a pivot device, the contact pressure force of the plug on being maintained until the elastic plugging compound pressed through the plug gun into the tap hole opening of the furnace has hardened.

In the known tap hole plug guns, the danger exists during the manual filling of the plugging compound into the cylinder chamber of the pressure cylinder that due to incorrect operation of the smelter or a coworker, the plugging piston will execute an unintentional forward stroke in the direction toward the mouthpiece of the pressure cylinder for the pre-compression and expulsion of the plugging compound and thus the smelter could suffer severe hand and arm injuries.

The embodiments of the invention are based on an object of improving the operational reliability of the tap hole plug gun according to the species.

The stop integrated in the safety flap for closing and opening the filling opening for the plugging compound of the pressure cylinder of the tap hole plug gun, which is automatically pivoted into the cylinder chamber of the pressure cylinder upon opening of the safety flap to decelerate an unintentional pre-compression or expulsion stroke of the plugging piston, represents a simple and cost-effective constructive measure for improving operational reliability of the tap hole plug gun.

BRIEF DESCRIPTION OF THE DRAWINGS

FIG. 3 shows an enlarged cross-sectional illustration of the tap hole plug gun along section line III-III of FIG. 2 with the closed position of the safety flap for the plugging compound filling opening, and FIG. 4 shows an enlarged cross-sectional illustration of the tap hole plug gun corresponding to FIG. 3 with the open position of the safety flap.

DETAILED DESCRIPTION OF THE PREFERRED EMBODIMENTS

Figure 1:
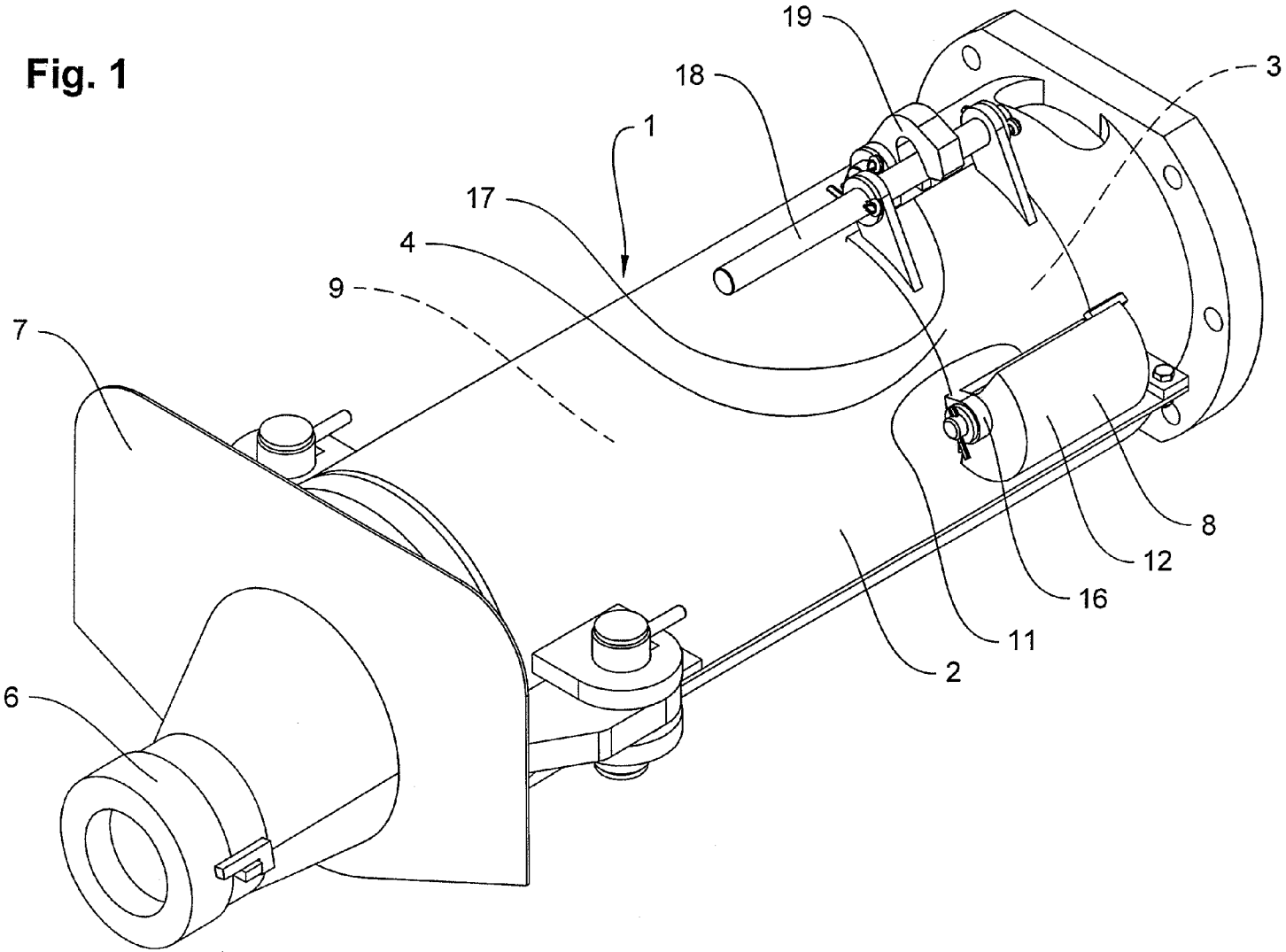
FIG. 1 shows a perspective illustration of a tap hole plug gun.
Figure 2:
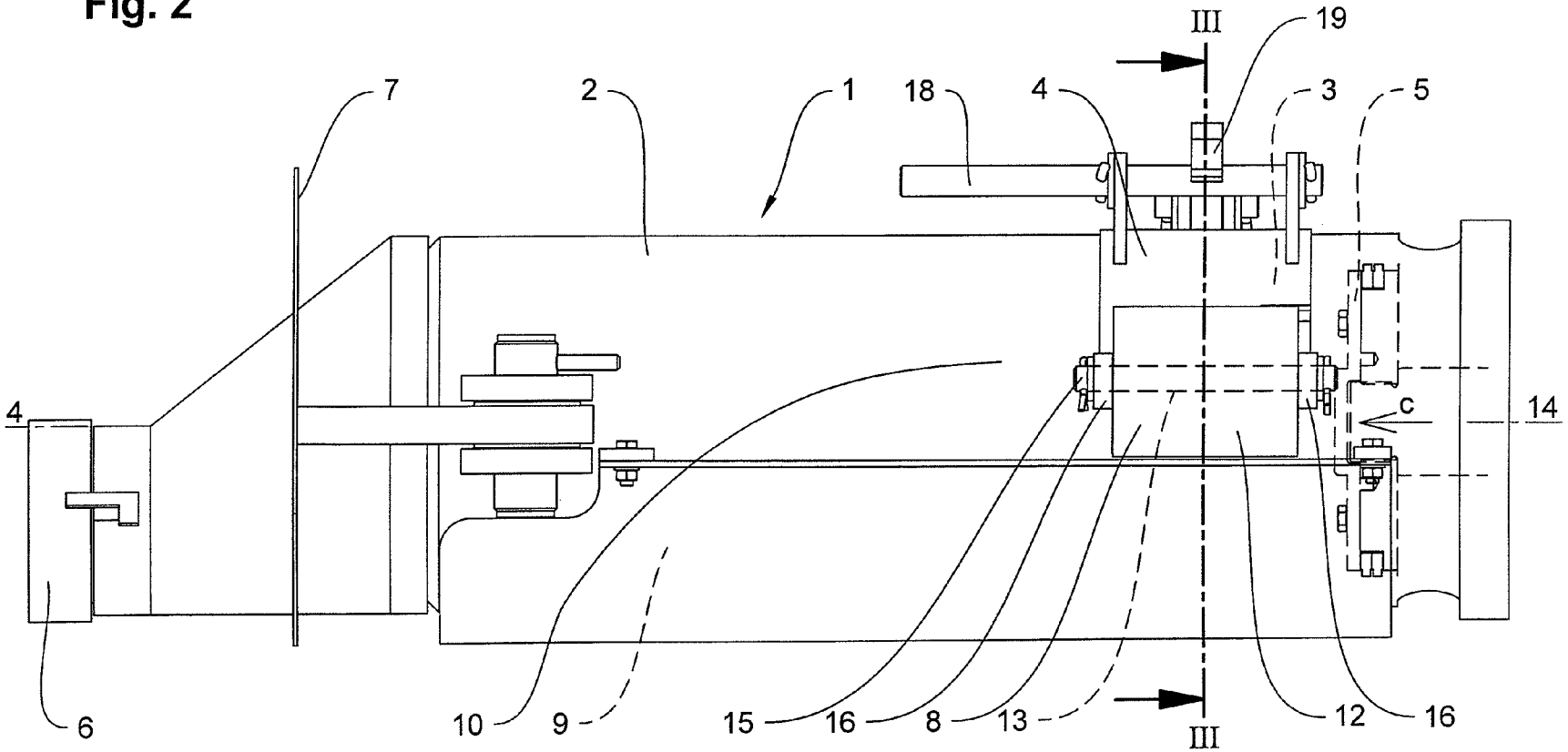
FIG. 2 shows a side view of the tap hole plug gun.

The tap hole plug gun 1 has a pressure cylinder 2 having a safety flap 4, which is pivotable in the arrow direction a out of the closed position 4*a* into the open position 4*b* and vice versa to open and close the filling opening 3 of the pressure cylinder 2 for the plugging compound, a plugging piston 5 for pressing the plugging compound out of a mouthpiece 6, which is pressed against the tap hole of a furnace, an electrohydraulic drive (not shown), for example, for the plugging piston 5, and a protective shield 7, which is situated on the mouthpiece 6, against the effect of heat and melted material exiting from the tap hole of a furnace.

The pivotable safety flap 4 for closing the filling opening 3 of the pressure cylinder 2 for the plugging compound is equipped with a stop 8, which, upon opening of the flap 4 by pivoting it in the arrow direction a into the open position 4*b*, is pivoted into the cylinder chamber 9 of the pressure cylinder 2 to decelerate an unintentional forward stroke of the plugging piston 5 in the arrow direction c for the pre-compression and expulsion of the plugging compound, and upon closing of the safety flap 4 by pivoting it in the arrow direction b into the closed position 4*a*, is pivoted out of the cylinder chamber 9.

The safety flap 4 is implemented as curved corresponding to the jacket 10 of the pressure cylinder 2 and engages positively in the filling opening 3 of the pressure cylinder 2 in the closed position 4*a*.

A roller segment 12, which is outwardly directed in the closed position 4*a* of the safety flap, is situated on one transverse side of 11 of the safety flap 4 and is pivoted into the cylinder chamber 9 of the pressure cylinder 2 in the open position 4*b* of this safety flap 4 and forms the stop 8 for the plugging piston 5.

The roller segment 12 has a concentric bearing hole 13, for example, for the pivot axis 15 of the safety flap 4, which is oriented parallel to the central axis 14-14 of the pressure cylinder 2 for receiving the plugging compound, and the pivot axis 15 is mounted fixed in bearing eyes 16 on the jacket 10 of the pressure cylinder 2.

A rod-shaped handle 18, which is oriented parallel to the central axis 14-14 of the pressure cylinder 2, is attached in the area of the other transverse side 17 of the safety flap 4, which is lockable in the closed position 4*b* of the safety flap 4 using a hook 19 linked on the jacket 10 of the pressure cylinder 2.

The various embodiments described above are provided by way of illustration only and should not be construed to limit the invention. Those skilled in the art will readily recognize various modifications and changes which may be made to the present invention without strictly following the preferred embodiments and applications illustrated and described herein, and without departing from the true spirit and scope of the present invention which is set forth in the following claims.

What is claimed is:

1. A tap hole plug gun for metallurgical furnaces, having a pressure cylinder having a jacket defining a cylinder chamber for receiving the plugging compound, which has a closable filling opening for the plugging compound, and having a plugging piston for pressing out the plugging compound from a mouthpiece of the pressure cylinder, which is pressed against the tap hole of a furnace, characterized by a pivotable safety flap for closing the filling opening of the pressure cylinder for the plugging compound, the safety flap having a stop for the plugging piston, which is pivoted into the cylinder chamber of the pressure cylinder upon opening of the flap to decelerate an unintentional forward stroke of the plugging piston for pre-compression and expulsion of the plugging compound, and is pivoted out of the cylinder chamber upon closing of the safety flap.

2. The tap hole plug gun according to claim 1, characterized in that, on one transverse side of the safety flap, which is curved corresponding to the jacket of the pressure cylinder, and engages positively in the filling opening of the pressure cylinder for the plugging compound in a closed position, a roller segment, which is directed outward in the closed position of the safety flap, is situated, which is pivoted into the cylinder chamber of the pressure cylinder in an open position of the safety flap and forms the stop for the plugging piston, and the roller segment has a bearing hole for the pivot axis of the safety flap, which is oriented parallel to a central axis of the pressure cylinder for the plugging compound, and which is mounted fixed in bearing eyes on the jacket of the pressure cylinder.

3. The tap hole plug gun according to claim 1, characterized by a handle, which is attached to the safety flap, and is oriented parallel to the central axis of the pressure cylinder, and a hook, which is linked on the jacket of the pressure cylinder and engages on the handle, for locking the safety flap in its closed position.

4. The tap hole plug gun according to claim 2, characterized by a handle, which is attached to the safety flap in an area of another transverse side of the safety flap, and is oriented parallel to the central axis of the pressure cylinder, and a hook, which is linked on the jacket of the pressure cylinder and engages on the handle, for locking the safety flap in its closed position.

* * * * *